US012760471B2

(12) United States Patent
Börjesson et al.

(10) Patent No.: US 12,760,471 B2
(45) Date of Patent: Oct. 13, 2026

(54) PROCESS FOR MANUFACTURING A FIBER BASED CELLULOSE WEB FOR DRY FORMING

(71) Applicant: SÖDRA SKOGSÄGARNA EKONOMISK FÖRENING, Växjö (SE)

(72) Inventors: Katrin Börjesson, Varberg (SE); Linda Echardt, Varberg (SE)

(73) Assignee: SÖDRA SKOGSÄGARNA EKONOMISK FÖRENING, Växjö (SE)

( * ) Notice: Subject to any disclaimer, the term of this patent is extended or adjusted under 35 U.S.C. 154(b) by 1059 days.

(21) Appl. No.: 17/797,332

(22) PCT Filed: Feb. 1, 2021

(86) PCT No.: PCT/EP2021/052283
§ 371 (c)(1),
(2) Date: Aug. 3, 2022

(87) PCT Pub. No.: WO2021/156190
PCT Pub. Date: Aug. 12, 2021

(65) Prior Publication Data

US 2023/0077220 A1 Mar. 9, 2023

(30) Foreign Application Priority Data

Feb. 6, 2020 (SE) ..... 2050129-2

(51) Int. Cl.
*D21H 15/04* (2006.01)
*D21C 9/18* (2006.01)
(Continued)

(52) U.S. Cl.
CPC ..... *D21H 15/04* (2013.01); *D21C 9/18* (2013.01); *D21F 9/00* (2013.01); *D21H 27/00* (2013.01); *D21H 27/42* (2013.01)

(58) Field of Classification Search
CPC ..... D21H 15/04; D21H 27/00; D21H 27/42; D21C 9/18; D21F 9/00
See application file for complete search history.

(56) References Cited

U.S. PATENT DOCUMENTS 3,055,795 A * 9/1962 Eberhardt ..... D21C 9/185 162/1
3,316,141 A * 4/1967 Bergholm ..... D21F 1/66 159/DIG. 25
(Continued)

FOREIGN PATENT DOCUMENTS

EP 0427317 A2 5/1991
EP 0875224 A1 * 11/1998 ..... A61F 13/5323
(Continued)

OTHER PUBLICATIONS

Smook, Handbook for Pulp and Paper Technologists, 1992, Angus Wilde Publications, 2nd edition, chapters 9 and 13. (Year: 1992).*
(Continued)

*Primary Examiner* — Anthony Calandra
(74) *Attorney, Agent, or Firm* — Renner, Otto, Boisselle & Sklar, LLP

(57) ABSTRACT

The present inventive concept relates to a process for manufacturing a fiber based cellulose web for dry forming comprising. The process comprises providing a wet cellulose pulp; free drying said wet cellulose pulp to a free dried cellulose pulp, wherein said free drying provides a curl to fibres of said free dried cellulose pulp; separating said free
(Continued)

dried cellulose pulp into individual free dried cellulose pulp fibres; and forming said individual free dried cellulose pulp fibres into a cellulose web.

11 Claims, 4 Drawing Sheets

(51) Int. Cl.
*D21F 9/00* (2006.01)
*D21H 27/00* (2006.01)
*D21H 27/42* (2006.01)

(56) References Cited

U.S. PATENT DOCUMENTS 3,414,469 A * 12/1968 Brown ..... D21C 9/004 162/84
5,709,774 A * 1/1998 Naieni ..... A61L 15/28 162/65
2003/0089478 A1* 5/2003 Tanner ..... D21B 1/066 162/261
2004/0127869 A1* 7/2004 Hu ..... D21C 9/18 604/376
2008/0073043 A1* 3/2008 Greschik ..... D21C 9/18 162/17
2009/0199349 A1 8/2009 Weinstein
2013/0139980 A1* 6/2013 Ban ..... D21H 17/20 162/76
2018/0326699 A1 11/2018 Knowlson

FOREIGN PATENT DOCUMENTS

EP 0947549 A1 * 10/1999 ..... D21H 21/22
EP 2971351 A1 1/2016
SE 1750313 A1 9/2018
WO 0039389 A1 7/2000
WO WO-2010078640 A1 * 7/2010 ..... D21B 1/066
WO 2011009997 A2 1/2011
WO 2017160218 A1 9/2017
WO WO-2019110868 A1 * 6/2019 ..... D21H 17/13

OTHER PUBLICATIONS

International Search Report and Written Opinion issued in connection with corresponding PCT Patent Application No. PCT/EP2021/052283 dated Apr. 9, 2021.

* cited by examiner

PROCESS FOR MANUFACTURING A FIBER BASED CELLULOSE WEB FOR DRY FORMING

RELATED APPLICATIONS

The present invention is a U.S. National Stage under 35 USC 371 patent application, claiming priority to Serial No. PCT/EP2021/052283, filed on Feb. 1, 2021, which claims priority from Swedish Patent Application No. 2050129-2 filed on Feb. 6, 2020; the entireties of both are hereby incorporated herein by reference.

TECHNICAL FIELD

The present inventive concept relates to a fiber based cellulose web for dry forming and a process for manufacturing a fiber based cellulose web for dry forming.

BACKGROUND

Cellulose products have experienced an increased usage during the past years. For environmental reasons are plastic materials gradually forced out by consumers and industry.

A novel technology to produce fiber based products is dry forming. Dry forming has been developed during recent years and is known as a method that requires little energy, e.g. compared to wet moulding.

In dry forming, a fiber base web is fed to a pressure moulding apparatus, also known as a compression moulding apparatus, and subsequently pressed to a fiber based product. Examples of fiber based webs are airlaid or wetlaid nonwoven. The characteristics of the final product are dependent on e.g. pressure time, temperature, pressure force, and humidity and use of additives in the cellulose web.

In EP 1 840 043 there is disclosed manufacturing of a three-dimensionally shaped packaging product by hot pressing of airlaid fluff material comprising natural fibres. In EP 1 840 043 thermoplastic fibres are preferably added to increase the formability of the fluff in the sense that the fluff may be stretched to a greater extent without failing. However, the addition of thermoplastic ingrediencies removes the sustainable features of the cellulose since the composite will not be recyclable.

WO 2019/209160 discloses a method for producing a cellulose product having a flat or non-flat product shape by a pressure moulding apparatus comprising a forming mould. In WO 2019/209160 a second carrying layer with high tensile strength is arranged on a first layer having lower tensile strength of the cellulose web to avoid that the first layer will break during production of the cellulose product. However, this is not beneficial in energy and/or economic points of view.

The fiber base web used for dry forming is traditionally manufactured from sheet pulp or fluff pulp. Sheet pulp is made of wet pulp that has been spread out on a screen and then pressed through a series of rotating rolls that squeeze of water and air. Fluff pulp is normally made as rolls on a drying machine to produce a uniform sheet. One of the most common applications of fluff pulp is as raw material in absorbent cores.

It is well established that the fibres in pulps are not straight but deviate from their native form in a variety of ways. This could for example be due to twists, curls, nodes, or micro-compressions. However, in both sheet pulp and fluff pulp, the fibres are mechanically straightened during the drying process and/or subsequently pressed. Hereby, it's natural twist or curl is lost.

Moreover, a bale of flash pulp pressed to standard density (around 900 kg/m$^3$) cannot be disintegrated into an airlaid with high stretch and tensile strength due to fiber cutting and fines generation during bale opening and hammer milling.

A challenge with the current state of the art is thus that complex cellulose products such as food containers having sharp inclined edges and/or deep cavities, have been difficult to produce.

The present inventive concept seeks to provide a process for manufacturing a cellulose web intended for pressure moulding that makes it possible to provide more complex products and that is more reliable than prior art solutions.

SUMMARY OF THE INVENTION

In the light of the above, it is an object of the present inventive concept to provide a fiber based cellulose web, produced from free dried cellulose pulp, for dry forming of cellulose products, and a process for manufacturing such fiber based cellulose web, wherein the above-mentioned disadvantages of the prior art are addressed.

The present inventive concept is based on the insight that the processability of a cellulose web is dependent on the toughness of the same, and that the toughness of the cellulose web may be increased by the curl of cellulose fibres.

According to at least a first aspect of the present inventive concept, there is provided a process for manufacturing a fiber based cellulose web for dry forming. The process comprises: providing a wet cellulose pulp; free drying the wet cellulose pulp to a free dried cellulose pulp, wherein the free drying provides a curl to fibres of the free dried cellulose pulp; separating the free dried cellulose pulp into individual free dried cellulose pulp fibres; and forming the individual free dried cellulose pulp fibres into a cellulose web.

The term free drying should here be interpreted as drying the wet cellulose pulp in air without restraint. Hereby, the term free dried cellulose pulp should be interpreted as free air-dried cellulose pulp.

The expression individual free dried cellulose pulp fibres should be interpreted to include singular free dried cellulose pulp fibres and a plurality of free dried cellulose pulp fibres.

The step of free drying the wet cellulose pulp induces a natural curl to the cellulose pulp fibres. This is a result of stresses in the hemicellulose-lignin matrix that tend to keep the fiber curled. It should be noted that the present invention makes a distinction between curves and twists. A curled fiber may be described as a wavy fiber whereas a twisted fiber may be described as a spiral formed fiber. Although free drying may induce not only curls to the fibres but also twists, the present invention is directed to curls since it is believed that the curls are the major reason for the fibres ability to intermingle with each other. Curled free dried cellulose pulp fibres intermingle better than straight cellulose pulp fibres and therefore contributes to high toughness and integral strength of the cellulose web. Hence, the curls of the cellulose pulp fibres contribute to a cellulose web having increased toughness compared to a cellulose web comprising non-curled cellulose pulp fibres. When used in dry forming, high toughness of the cellulose web is important for runnability and processability. Thus, curled cellulose pulp fibres has the advantage that a complex cellulose product may be produced in a subsequent step of dry forming.

It should be understood that toughness depending on the context may include at least any one of fracture toughness, tensile strength index, elongation at break, and Tensile Energy Absorption index (TEA). Fracture toughness describes the ability of the material to resist the propagation of a pre-existing crack and tensile strength gives the maximum tension-carrying capacity of the product.

Furthermore, free drying of the wet cellulose pulp also improves the drape characteristics of the cellulose web; i.e. the cellulose web will have an improved ability to fold on itself and to conform to the shape of the moulds in a subsequent step of pressure moulding.

The inventive concept thus presents the advantage that the cellulose web can better withstand the forces applied during a pressure moulding process and formation compared to a cellulose web with low toughness. This is beneficial since the risk of cracks formed in the cellulose product during production is reduced. Especially, if the production relates to three-dimensional cellulose products with sharp inclined edges and/or deep cavities. Additionally, the inventive concept presents the advantage that a cellulose product can be manufactured from a cellulose web containing only a single layer and removes the need of a carrier layer.

Curled cellulose fibres are commonly used in the sanitary industry for absorbent properties, bulk, and resilience. An example of this is U.S. Pat. No. 6,780,201 which describes curly cellulose fibres having a high wet resiliency and a method of making high wet resiliency curly cellulose fibres with a chemically-assisted curling method. The purpose of the curly cellulose fibres in U.S. Pat. No. 6,780,201 is mainly to achieve high absorbency and to allow the cellulose fiber to be stiff enough to not collapse upon wetting. It is not intended to be used in a cellulose web with improved toughness. An absorbent product does not at all have the same requirements of toughness as a fiber based cellulose web intended to be used in dry forming of cellulose products.

WO 03052200 describes a method of modifying a two-dimensional, flat fiber morphology of a never-been-dried wood pulp into a three-dimensional twisted fiber morphology without the aid of a chemical cross-linker. Just like the curly cellulose fibres of U.S. Pat. No. 6,780,201 the purpose of WO 03052200 is to increase absorbency of the cellulose fibres and not to achieve high toughness of a cellulose web.

Individualization of cellulose pulp fibres removes eventual fiber bundles present in the cellulose fiber pulp after the step of free drying. This is advantageous is that nodules are prohibited in the cellulose web and consequently also in the fiber based product.

According to one example embodiment, the step of free drying is performed in hot air, and preferably by using flash drying.

Flash drying is defined as an instant drying of small flocks of well-squeezed wet pulp wherein flocks with consistency around 50% are forced to tumble in a hot air flow. The flocks are obtained by pressing the wet pulp followed by a shredding device.

The consequences of flash drying are fiber deformations, such as curling and kinking. During flash drying, the deformations are further increased due to the spiral deposition of the cellulose fibrils in the fiber cell wall.

According to one example embodiment, the hot air temperature is above 100° C., preferably above 130° C., and most preferably above 150° C.

A high temperature of the hot air provides the advantage that the time of free drying can be short.

According to one example embodiment, the free drying is performed in less than 10 minutes, and preferably less than 5 minutes.

Hereby, the time for imposing the curl and/or twist to the cellulose pulp is short. Consequently, the process for manufacturing a fiber based cellulose web can also be short.

According to one example embodiment, the process further comprises compacting the free dried cellulose pulp to a density between 50-500 kg/m$^3$, or 100-400 kg/m$^3$, or preferably between 200-300 kg/m$^3$.

Hereby, the free dried cellulose pulp is compacted such that the density of the free dried cellulose pulp is decreased without negative impact on the curls of the free dried cellulose pulp fibres. It is preferable not to press the cellulose pulp to a density above 500 kg/m$^3$ since this might contribute to an increase of the shape factor of the free dried cellulose pulp.

Furthermore, compacting the free dried cellulose pulp to a density more than 500 kg/m$^3$ may cause fiber cutting and fines generated during subsequent steps of opening and/or separation of individual free dried cellulose pulp fibres.

According to one example embodiment, the free dried cellulose pulp is compacted into a bale and wherein the bale is opened before the free dried cellulose pulp fibres are formed into a web.

This is advantageous in that the free dried cellulose pulp can easily be transported to a forming apparatus that is not situated near the site for manufacturing of the free dried cellulose pulp.

According to one example embodiment, the process further comprises adding one or more additives to the wet cellulose pulp to obtain a homogenous distribution of the additives.

In one example embodiment additives can be distributed onto the wet cellulose pulp before the step of free drying. This is advantageous since distribution of additives to the cellulose pulp in wet stage provides for a uniform and good distribution.

Furthermore, additives are often provided in liquid phase and by adding additives to the wet cellulose pulp before the step of free drying, mitigates the risk of losing the curls of the free dried cellulose pulp. Hence, by adding the additives to the wet cellulose pulp before the step of free drying, this risk of losing the curls of the cellulose fibres are mitigated.

Moreover, the cellulose pulp does not have to be moisturized since it already comes in a wet stage from the pulping process. This means that the curls of the fibres are more likely to be maintained until the fiber based cellulose web is pressed to a fiber based product.

Moreover, the addition of additives already in the liquid phase to the wet cellulose pulp, before the step of free drying, avoids the step of a second liquid phase for adding additives as well as a second drying process and thus avoids the use of additional energy for drying a second time.

According to one example embodiment, the one or more additives provides any one of or a combination of hydrophobicity, strength, increased bulk properties, and debonding. Non-limiting examples of additives to be added to achieve hydrophobicity are alkyl ketene dimer (AKD), Alkenyl Succinic Anhydride (ASA) or rosin compounds. Non-limiting examples of additives to be added to achieve strength are Sodium Carboxymethyl Cellulose (CMC), cationic polyacrylamide (C-PAM), starch compounds such as cationic starch (native or modified), or Polyethyleneimine (PEI). Non-limiting examples of additives to be added to achieve bulk are polymaleic acid or poly-carboxylic acids such as Citric acid or butane tetracarboxylic acid (BTCA).

According to one example embodiment, the free-drying is performed until the free-dried cellulose pulp has a moisture content of 5-20%, and preferably 7-12%.

Hereby, the fibres of the cellulose pulp have adapted a curled and twisted shape that can maintain during the formation of the cellulose web and enhance good runnability properties of the cellulose web when manufacturing a fiber based cellulose product.

According to a second aspect of the inventive concept, there is provided a fiber based cellulose web for dry forming of cellulose products, produced from wet cellulose pulp which has been free dried.

The free dried cellulose pulp provides good drapeability properties to the fiber based cellulose web. Good drapeability properties is advantageous in that it makes it possible to manufacture both rigid flat and complex 3D cellulose products.

According to one example embodiment, the cellulose web is an airlaid (nonwoven).

Hereby, air is used as carrying medium in the step of formation of the cellulose pulp fibres into the structure of a cellulose web. An airlaid is advantageous in dry forming of cellulose products because it is bulky, porous, and soft.

According to one example embodiment, fibres of the free dried cellulose pulp has a shape factor of less than 83%, for example 80%, when formed into a web.

Shape factor is defined as the projected length of the fiber divided by its fully length when stretched out.

Hereby, the fibres of the cellulose web are more curled and/or twisted than the fibres of a cellulose web made from fluff pulp or sheet pulp.

According to one example embodiment, the fiber based cellulose web has an elongation at break of at least above 17%, preferably above 20%, and most preferably above 25%, measured according to ISO 12624-4: 2017.

Hereby, the drapeability properties of the cellulose web is satisfactory to produce complex rigid flat and/or 3D products.

According to a third aspect of the inventive concept the use of the fiber based cellulose web in dry forming of rigid flat and/or 3D products is provided. Non-limiting examples of rigid flat and/or 3D products are trays, containers, and packaging products.

According to an embodiment, the fiber based cellulose web may be used in dry forming of packaging such as food packaging, bottles, food carriers for ready meals, consumer products such as hygiene products, cosmetics, electronics, and industrial packaging.

DEFINITIONS

The term a curl is defined as a change in the axial direction, such as a ringlet or a wave, as illustrated in the figure below. A curly fiber may be described as a wavy fiber or a curved fiber.

The term kink is defined as a sharp, abrupt change in the axial direction. It should be noted the kinks are in this context included in the term curl whereas twists are not.

The curl may be calculated by curl index (CI), defined as the ratio of the true contour length L of the fiber divided by the projected length, I of the fiber minus 1. The curl can also be calculated by measuring the shape factor, defined as the projected length of the fiber divided by its fully length when stretched out.

The term twist is defined as a coil or a spiral. A twisted fiber may be described as a spiral formed fiber or a helically twisted fiber.

The term dry forming is in this context meant dry molding or pressure moulding.

BRIEF DESCRIPTION OF THE DRAWINGS

Non-limiting embodiments of the present disclosure will be described in greater detail with reference to the accompanying drawings in which.

DETAILED DESCRIPTION

Figure 1:
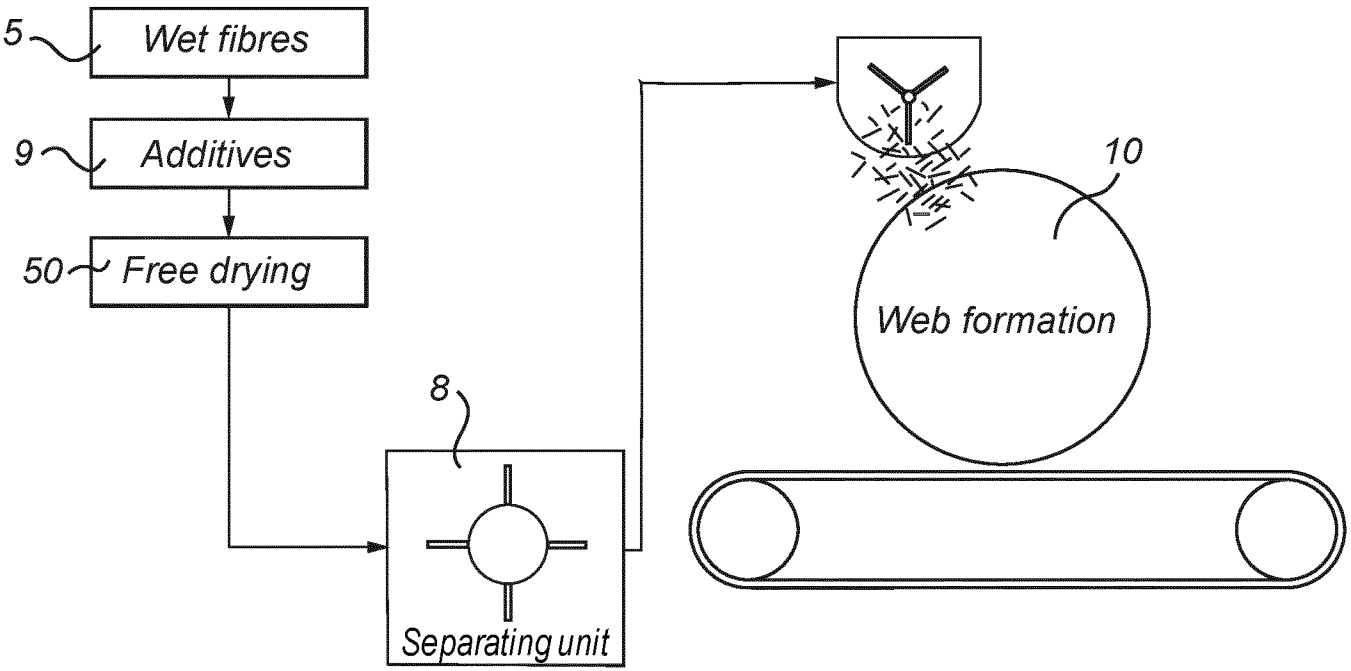
FIG. 1 shows a schematic view over a continuous web formation process.

FIG. 1 shows a schematic view over a continuous web formation process. In the first step, wet cellulose pulp fibres (5) are provided. The wet cellulose pulp (5) may be provided directly from a pulp mill. Optionally, the wet cellulose pulp is impregnated with one or several additives (9) before it is subjected to free drying (50), such as flash drying. Non-limiting examples of additives are alkyl ketene dimer (AKD), Alkenyl Succinic Anhydride (ASA), rosin compounds, Sodium Carboxymethyl Cellulose (CMC), cationic polyacrylamide (C-PAM), starch compounds such as cationic starch (native or modified), Polyethyleneimine (PEI), polymaleic acid, poly-carboxylic acids such as Citric acid or butane tetracarboxylic acid (BTCA).

Free drying means that wet fibres are subjected to hot air without being subjected to restraint, i.e. dried in a free state. Thus, the free dried fibres adapt a natural curly shape. The temperature of the hot air in the free drier (50) may be above 150° C. The temperature of the hot air may be stepwise increased or stepwise decreased during the step of free drying. Alternatively, the temperature of the hot air is constant during the step of free drying. The time for free drying is preferably less than 5 minutes. During the step of free drying (50), the moisture content of the wet fibres (5) decreases to an interval of 7-12%.

In the next step, the free dried cellulose pulp (50) is transported to a separating unit (8). Non-limiting examples of separator unit for separation of the free dried cellulose pulp into individual free dried cellulose pulp fibres are hammermill and dosing unit. In the separator unit the free dried cellulose pulp is separated into individual free dried cellulose pulp fibres. The separation of individual free dried cellulose pulp fibres is advantageous to avoid an inhomogeneous distribution of cellulose pulp fibres in the cellulose web (10). After the separating unit (8), the free dried fibres are formed into a cellulose web (10) in a web formation unit. The cellulose web can be provided either as a monolayer or as part of a multilayer material matrix, supplemented by e.g. films of tissue or polymer.

This step may be used by air as carrying medium which results in a cellulose web in the form of an air laid. The curls of the free dried fibres enhance entanglement of the cellulose pulp fibres which results in a cellulose web provided with high toughness. High toughness of the cellulose web is beneficial to provide good runnability in a subsequent the step of pressure moulding. The high toughness of the cellulose web makes it possible to press complex products of 3-D shape in the pressure mould.

Figure 2:
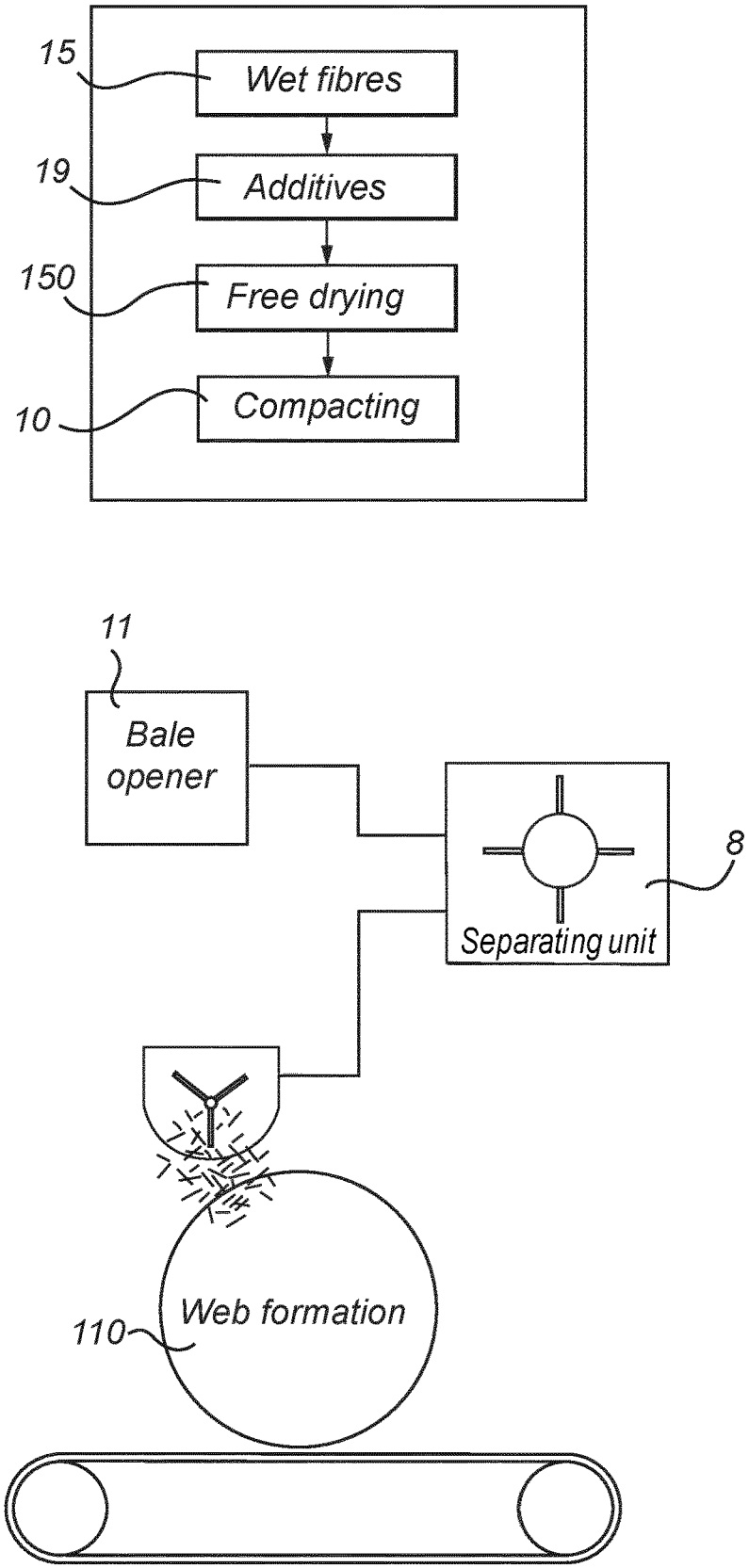
FIG. 2 shows a schematic view over a discontinuous web formation process.

FIG. 2 shows a schematic view over a discontinuous dry moulding process. The first three steps are the same as in FIG. 1; wet pulp (15) is provided and subjected to free drying (150) with an optional addition of additives (19) before the step of free drying (150).

Thereafter, the free dried fibres are compacted (10) to the desired density and packed into a sack, truck, or a bale. It is important that the free dried cellulose pulp is compacted with a low pressure such that the curls of the free dried cellulose pulp is maintained. Compacting is preferably performed until the density of the free dried cellulose pulp is up to 500 kg/m$^3$ and not more since this could negatively affect the curls of the free dried cellulose pulp. Compacting and bale formation enhances transportation of the free dried cellulose pulp to the web formation. Before the free dried cellulose pulp enters the web formation unit (110), the bales are opened by means of a bale opener (11) and the individual pulp fibres are separated in one or several separating units (18) as described in FIG. 1.

After the separating unit (18), the free dried cellulose pulp is formed into a cellulose web in the web formation unit (110).

Figure 3:
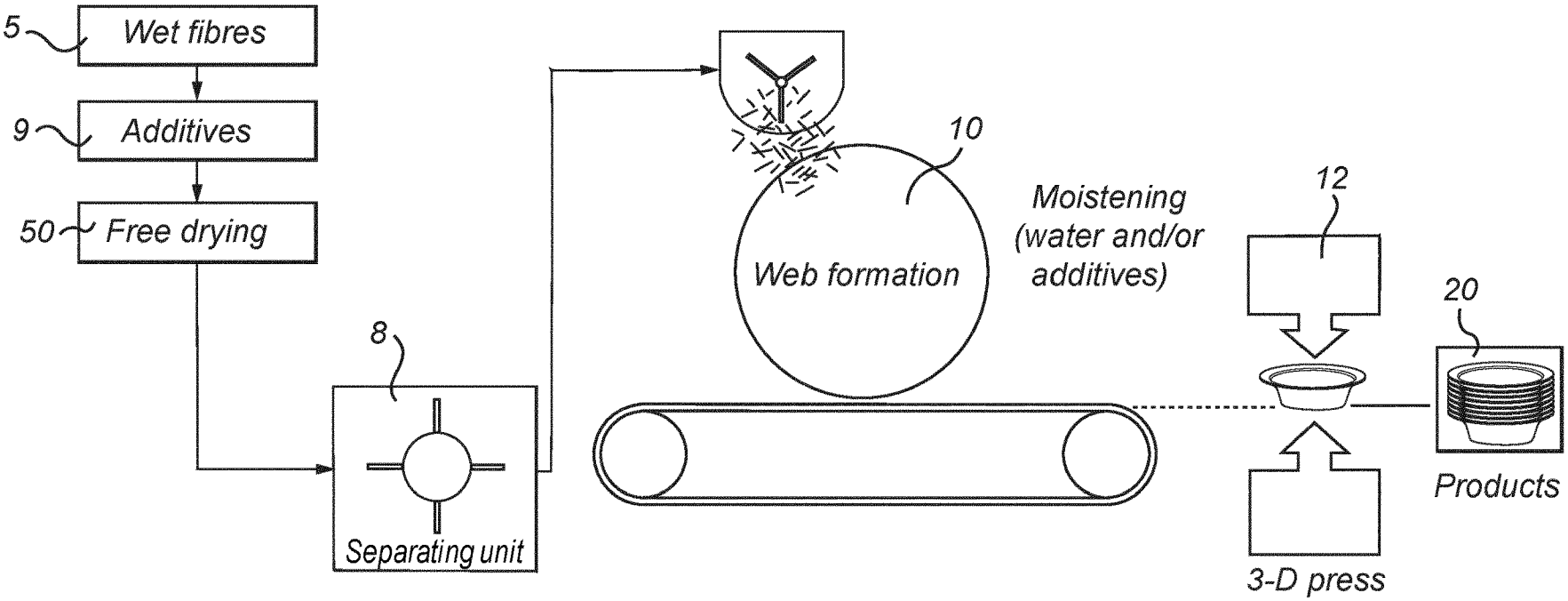
FIG. 3 shows a schematic view over a continuous dry moulding process based on the web forming process described in FIG. 1.

FIG. 3 shows a schematic view over a continuous dry moulding process based on the web formation process described in FIG. 1. After the step of web formation (110), the fiber based cellulose web is fed to a pressure mould (12). The fiber based cellulose web may be fed to the pressure mould either continuously or discontinuously from the web formation (10). High toughness of the cellulose web makes it possible to press complex products of 3-D shape (20).

Figure 4:
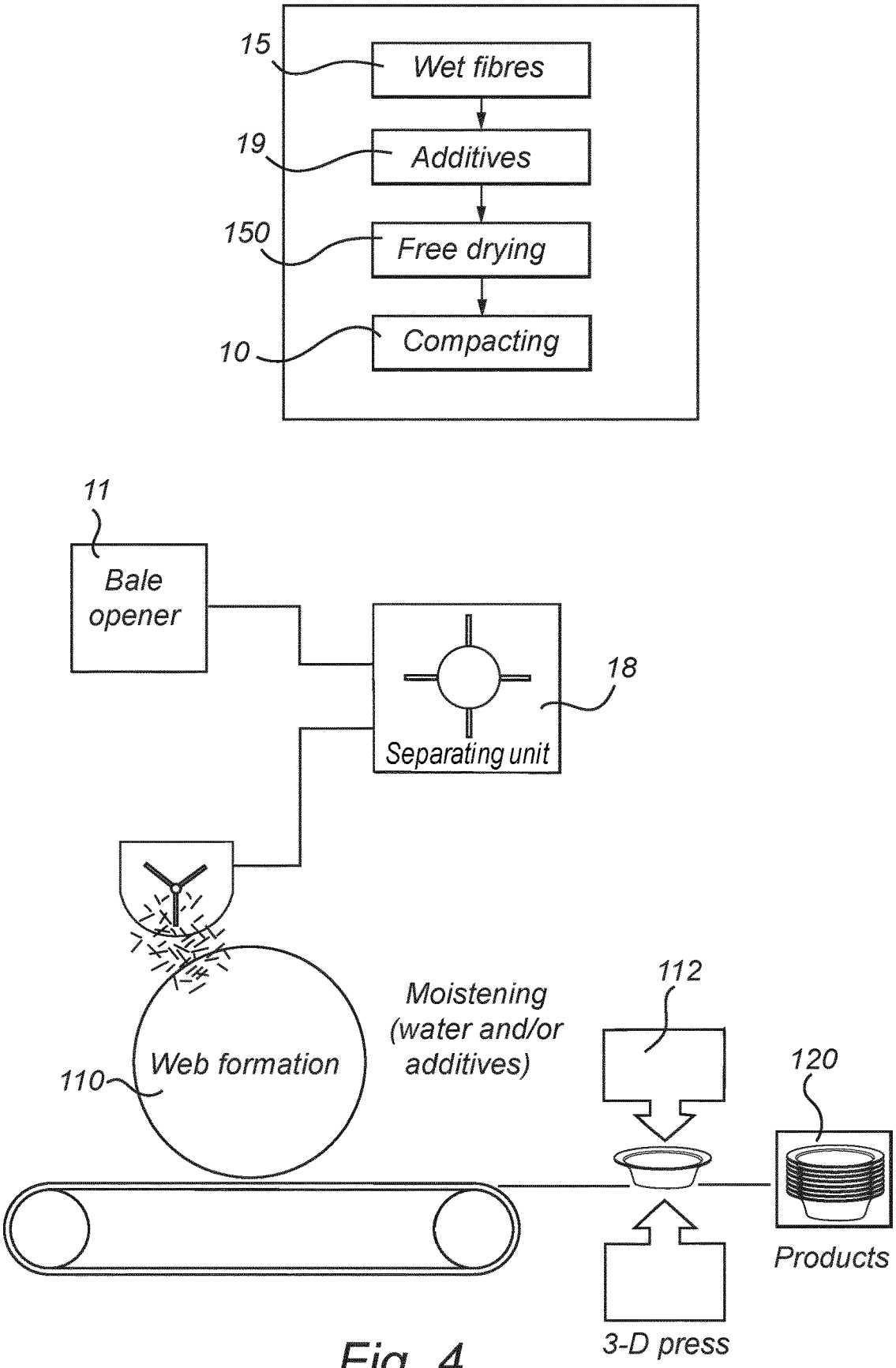
FIG. 4 shows a schematic view over a discontinuous dry moulding process based on the web forming process described in FIG. 2.

FIG. 4 shows a schematic view over a discontinuous dry moulding process based on the web formation process described in FIG. 2.

After the step of web formation (110), the fiber based cellulose web is fed to a pressure mould (112). The fiber based cellulose web may be fed to the pressure mould either continuously or discontinuously from the web formation (110). High toughness of the cellulose web makes it possible to press complex products of 3-D shape (120).

EXAMPLES

Non-limiting embodiments of the present disclosure will be described with reference to the following example.

Example 1

Tables 1, 2 and 3 comprise data derived from a reference material (air laid made from fluff pulp), test material A (air laid made from free dried pulp A), and test material B (air laid made from free dried pulp B).

As mentioned before, a cellulose web made from free dried cellulose pulp has the advantage of increased tensile strength and improved elongation at break. These measurements together indicate high toughness and ability of the cellulose web to drape.

The data shown in table 1, 2 and 3 clearly support the statement above; the tensile strength index is higher for both Test material A and Test material B in comparison to the reference material in both machine direction (MD) and in counter machine direction (CD). The Geometric Mean (GMT) is 118% higher for Test material A and 64% higher for Test material B than the reference.

In addition, the elongation at break is improved for both Test material A and Test material B in comparison to the reference material. The GMT is 118% higher for Test material A and 64% higher for Test material B than the reference.

Hereby, it is clearly shown that free drying has a positive impact on the toughness of the cellulose web.

TABLE 1

Test data derived from measurements in MD direction

| | | Airlaid fluff pulp (reference) | Test material A | Test material B |
|---|---|---|---|---|
| Tensile strength index | Nm/g | 0.018 | 0.041 | 0.032 |
| Elongation at break | % | 15.1 | 25.6 | 24.7 |
| Tensile Energy Absorption index (TEA) | J/kg | 1.67 | 5.83 | 4.32 |
| Increase Tensile | % | 0 | 133 | 83 |
| Increase Elongation | % | 0 | 70 | 64 |
| Increase TEA | % | 0 | 249 | 158 |

TABLE 2

Test data derived from measurements in CD direction

| | | Airlaid fluff pulp (reference) | Test material A | Test material B |
|---|---|---|---|---|
| Tensile strength index | Nm/g | 0.023 | 0.047 | 0.034 |
| Elongation at break | % | 17.2 | 30.4 | 29.0 |
| Tensile Energy Absorption index (TEA) | J/kg | 2.42 | 7.91 | 5.39 |
| Increase Tensile | % | 0 | 104 | 48 |
| Increase Elongation | % | 0 | 77 | 69 |
| Increase TEA | % | 0 | 226 | 123 |

TABLE 3

Test data derived from calculation of the geometric mean [√(MD * CD)].

| | | Airlaid fluff pulp (reference) | Test material A | Test material B |
|---|---|---|---|---|
| Tensile strength index | Nm/g | 0.020 | 0.044 | 0.033 |
| Elongation at break | % | 16.1 | 27.9 | 26.7 |
| Tensile Energy Absorption index (TEA) | J/kg | 2.01 | 6.79 | 4.83 |
| Increase Tensile | % | 0 | 118 | 64 |
| Increase Elongation | % | 0 | 73 | 66 |
| Increase TEA | % | 0 | 237 | 140 |

The shape of the free dried cellulose pulp is more curled and/or more twisted than the shape of a cellulose fiber that has been subjected to restrained drying or press after drying. The curl of a fiber can be measured by calculation of shape factor; defined as the projected length of the fiber divided by its fully length when stretched out. By free drying it is possible to obtain a cellulose pulp fiber having a lower shape factor than what is possible for sheet pulp fibres or fluff pulp fibres. This is visualized in table 4 showing that the shape factor of free dried cellulose pulp fibres (whether compacted or not) have lower shape factor (80-82%) than the shape factor of fluff pulp and sheet pulp (84-86%).

Free dried cellulose pulp fibres that has been compacted is higher than the shape factor of free dried cellulose pulp that is not compacted. The former has a shape factor of 82% and the latter has a shape factor or 80%.

TABLE 4

| Test data derived from | Shape factor [%] |
|---|---|
| Sheet pulp | 84-86 |
| Fluff pulp on role | 86 |
| Free dried pressed cellulose pulp - bale | 82 |
| Free dried cellulose pulp - not compacted | 80 |

The invention claimed is:

1. A process for manufacturing a fiber based cellulose web for dry forming comprising:

a) providing a wet cellulose pulp;

b) free drying said wet cellulose pulp to a free dried cellulose pulp, wherein said free drying provides a curl to fibres of said free dried cellulose pulp, said step of free drying being performed in hot air, by using flash drying, the hot air temperature being above 100° C.;

c) compacting said free dried cellulose pulp to a density between 100-400 kg/m$^3$ into compacted free dried cellulose pulp;

d) separating said compacted free dried cellulose pulp into individual free dried cellulose pulp fibres; and e) forming said individual free dried cellulose pulp fibres into a cellulose web.

2. The process according to claim 1, wherein said free dried cellulose pulp is compacted into a bale and wherein said bale is opened before said individual free dried cellulose pulp fibres are formed into a web.

3. The process according to claim 1, further comprising adding one or more additives to said wet cellulose pulp to provide any one or a combination of hydrophobicity, strength, increased bulk properties, and debonding and to obtain a homogenous distribution of said additives.

4. The process according to claim 1, wherein air is used in said step of forming said individual free dried cellulose pulp fibres into a cellulose web, such that said cellulose web is airlaid.

5. The process according to claim 1, wherein said free drying is performed until said free-dried cellulose pulp has a moisture content of 5-20%.

6. The process according to claim 5, wherein said free drying is performed until said free-dried cellulose pulp has a moisture content of 7-12%.

7. The process according to claim 1, wherein said free drying is performed in less than 10 minutes.

8. The process according to claim 7, wherein said free drying is performed in less than 5 minutes.

9. The process according to claim 1, wherein the hot air temperature being above 130° C.

10. The process according to claim 1, wherein the hot air temperature being above 150° C.

11. The process according to claim 1, wherein compacting said free dried cellulose pulp is to a density between 200-300 kg/m$^3$.

* * * * *